US007343966B2

(12) United States Patent
Nitta

(10) Patent No.: US 7,343,966 B2
(45) Date of Patent: Mar. 18, 2008

(54) STAMPED MANIFOLD FOR A HEAT EXCHANGER AND METHOD FOR MAKING SAME

(75) Inventor: Takeyoshi Nitta, Ontario (CA)

(73) Assignee: Newfield Technology Corporation, Ontario, CA (US)

( * ) Notice: Subject to any disclaimer, the term of this patent is extended or adjusted under 35 U.S.C. 154(b) by 425 days.

(21) Appl. No.: 11/156,292

(22) Filed: Jun. 17, 2005

(65) Prior Publication Data

US 2006/0283583 A1 Dec. 21, 2006

(51) Int. Cl.
*F28F 9/02* (2006.01)

(52) U.S. Cl. ..... 165/176; 165/174; 29/890.052

(58) Field of Classification Search ..... 165/173–176; 29/890.052
See application file for complete search history.

(56) References Cited

U.S. PATENT DOCUMENTS 4,770,240 A * 9/1988 Dawson et al. ..... 165/176
5,163,509 A * 11/1992 Dawson ..... 165/176
6,216,777 B1 * 4/2001 Rhodes et al. ..... 165/176
6,260,271 B1 * 7/2001 Hayashi ..... 29/890.035
6,736,203 B2 * 5/2004 Rhodes et al. ..... 165/176
7,273,093 B2 * 9/2007 Durr et al. ..... 165/176
2003/0217838 A1 * 11/2003 Dey et al. ..... 165/173

* cited by examiner

*Primary Examiner*—Allen J. Flanigan
(74) *Attorney, Agent, or Firm*—Pillsbury Winthrop Shaw Pittman LLP

(57) ABSTRACT

A stamped manifold for a heat exchanger includes a central portion having a plurality of mating tubular members for connection to tubes of a heat exchanger. The manifold includes a plurality of folds disposed between the mating tubular members to form a pair of channels below a plane of the central portion and a central fold above the plane of the central portion. The manifold includes a first extension member extending from a side edge of the central portion and a second extension member extending from another side of the central portion and opposing the first extension member. The free ends of the first extension member and the second extension member are disposed in the pair of channels in contact with the central fold and secured in place to define a first fluid conduit and a second fluid conduit.

15 Claims, 6 Drawing Sheets

STAMPED MANIFOLD FOR A HEAT EXCHANGER AND METHOD FOR MAKING SAME

BACKGROUND OF THE INVENTION

1. Field of the Invention

The present invention relates generally to heat exchangers and, more specifically, to a stamped manifold and a method of making the same for a heat exchanger.

2. Discussion of the Related Art

Heat exchangers are commonly utilized in air conditioning systems such as those found in a motor vehicle. Heat exchangers, such as condensers, are typically manufactured in a "tube and fin" fashion. The heat exchanger typically includes a plurality of U-shaped tubes having a fluid passing therethrough and a plurality of fins extending between the tubes. The fins are attached to the U-shaped tubes to effectively increase the surface area of the tubes, thereby enhancing heat transfer capability of the tubes. A number of U-shaped tubes and fins may be stacked on top of each other, leaving a small opening to allow passage of air in between them, to create "condenser cores."

The number of U-shaped tubes and fins depends on thermal capacity requirements of the heat exchanger. In order to connect these tubes together so that the fluid can flow through the tubes, manifolds are used having a series of openings or "mating" tubes corresponding to and mating with the ends of the U-shaped tubes. The manifolds have an inlet port and an outlet port which circulate the fluid through the heat exchanger and then return the fluid to a remote location for subsequent recycling. The condenser cores are typically rectangular in shape when assembled. The long U-shaped tubes, which are the foundation of condenser cores, are usually arranged so that the long-side of the tubes are horizontally arranged. Condensers are typically rectangular in shape, with one end of the condenser occupied by the manifold. Manifolds are long, pipe-like tanks with multiple mating tubes to attach to the open ends of the U-shaped tubes. Manifolds have distinct chambers inside to facilitate the flow of refrigerant. Manifolds are typically vertically arranged, so that the long end of the manifold is perpendicular to the ground. Manifolds typically have inlet and outlet ports, so that the refrigerant can be introduced from the rest of the air conditioner system to the manifold, and returned to the rest of the air conditioner system, once the refrigerant passes through the condenser.

There are many methods to manufacture manifolds, with several distinctive categories of methods. The first method is to entirely form the shape of a manifold through machining a solid piece of metal. This type of manufacturing process requires relatively low initial investment, typically utilizing computer numerical control (CNC) machining equipment. However, CNC machining can be cost detrimental for mass production of the manifolds due primarily to the amount of time it takes to machine a manifold. Since an entire shape of the manifold has to be cut out from a block of material, it may take hours to machine a manifold even with a very fast CNC machine. Therefore, this type of manufacturing method is not very well suited for high volume production, which is typically required for an automotive application.

The second method of manufacture is to utilize a cold-forging process, or a similar process called a back-extrusion process. Compared to the machining process, this type of manufacturing method requires far more initial investment. Firstly, cold-forging equipment or back-extrusion equipment must be acquired. Secondly, a dedicated die has to be manufactured to form the desired shape, in this case a shape of a manifold. Although productivity of cold-forged/back-extruded manifolds are far superior to manifolds manufactured by a machining process, there are several drawbacks. A cold-forged/back-extruded process requires a general shape to be formed via an extrusion process. The extrusion process creates a general outline of the manifold, typically out of an ingot of aluminum, thereby eliminating unnecessary machining. The extruded material is then machined to further shape the material to prep for the cold forging process. The machined shape is then cold-forged/back-extruded to form the detailed shape of the manifold. In particular, individual mating tubes on the manifolds that act as a receptacle to the individual U-shaped tubes are complex in shape. These mating tubes must first be machined to form solid, individual tubes not having the finished shape of a thin wall and openings to the inner manifold. This machined shape is then cold-forged/back-extruded to form the final shape with the thin wall and an opening to the inner side of the manifold (the mating tubes are not completely machined in the machining process, since doing so would be time-consuming and cost prohibitive). Although the cold-forging/back-extruded process is far more cost effective than machining, there are multiple manufacturing steps involved thereby increasing the manufacturing cost.

The third method of manufacture is a stamping process. In this approach, a manifold is manufactured out of generally flat sheet of metal, with the finished manifold consisting of either one sheet of metal or multiple sheets of metal. The quantity of sheet metal varying depending on different methods of manufacture. Forming the shape of the manifold is generally accomplished through the metal stamping process, using a die and a stamping press.

Generally, all stamped manifolds will have a few things in common. First, the individual mating tubes are shaped via a drawing process. Secondly, each end region of the sheet metal is bent into shape, so that each end region of the sheet metal forms two distinct tanks. Thirdly, all stamped manifolds are either soldered or brazed together, using either a cladded aluminum sheet metal (aluminum sheet metal with at least 2 layers of different aluminum alloys with varying liquefying temperature), or a standard sheet metal in combination with brazing sheet/soldering paste. Various examples of prior art embodiments are focused on the means of treating the two ends of the sheet metal to form the two separate chambers within the manifold.

A first prior art example of a stamped manifold is described in Dawson, U.S. Pat. No. 4,770,240. In this patent, sheet metal material in between a pair of mating tubes is bent away from the tubes to form a shape resembling an inverted "V". Each end of the sheet metal is then bent to form two separate tanks, with each end of the sheet metal bent to rest along the exterior surface of the inverted "V" shape. There are certain drawbacks to this design as discussed below. First, and foremost, in order to form the finished manifolds, extremely high heat is applied to the entire structure. When extremely high heat is applied to a material, especially a thin sheet of material, the material is prone to movement. Each end of the sheet metal simply rests against the inverted "V." In such a configuration, it is highly likely that the end of the bent sheet, along the entire length of the manifold, may not remain in position during the brazing/soldering process. This movement leads to areas that are not properly brazed/soldered. Since manifolds must be leak-free, such manifolds with void areas are useless. Therefore, this configuration may result in a high defect rate, leading to low productivity and high cost.

A second prior art example of a stamped manifold is described in Dawson, U.S. Pat. No. 5,163,509. The manifold as illustrated in this patent is constructed out of not a single sheet of metal, but two separate sheets of metal, with each sheet metal forming an individual manifold tank. Therefore, instead of having a single sheet of metal formed to create two individual tanks, the individual tanks are individually manufactured. The tanks are then positioned side-by-side to take the shape of the complete manifold. The two tanks have only one row of mating tubes individually, so that when the tanks are paired up they have the requisite pair of mating tubes to be attached to the U-shaped tubes. Although this embodiment resolves the issue of the brazing problem as discussed above with respect to Dawson U.S. Pat. No. 4,770,240, the cost to manufacture is higher than other embodiments of a stamped manifold.

The third embodiment of a stamped manifold is illustrated in Rhodes, U.S. Pat. No. 6,216,777 B1. In this patent, the approach to creating the two tanks is through the bending of the two ends of the sheet metal to form the individual tanks, which is similar to Dawson U.S. Pat. No. 4,770,240. However, in this case, the two ends of the sheet metal are not simply resting against the exterior surface of a bent inverted "V" portion of the sheet metal surface as in Dawson U.S. Pat. No. 4,770,240. Instead, a single central channel is created running the entire length of the manifold to act as a receptacle of the two ends of the sheet metal. By having a single central channel, this embodiment attempts to resolve the issue faced in Dawson U.S. Pat. No. 4,770,240, i.e., a relatively high likelihood of a brazing failure, due to movement of material when exposed to heat during brazing/soldering. Although Rhodes U.S. Pat. No. 6,216,777 B1 embodiment is a more robust design compared to Dawson U.S. Pat. No. 4,770,240, there are several shortcomings.

By having only a single channel to receive the two ends of the sheet metal, there is a potential for one end of the sheet metal to dominate the channel, forcing the other end of the sheet metal to be positioned out of the channel. This can occur for a portion of the channel or the entire length of the manifold. If either end of the sheet metal is not properly installed into the single channel several possible failure modes may occur. A first failure mode occurs when one end of the sheet metal is significantly off the single channel, thereby preventing the manifold tanks from properly sealing during the brazing/soldering process. If this occurs, the manifold may be useless, since manifolds have to be leak-proof. A second failure mode occurs when the end of the sheet metal is slightly off the single channel, thereby creating a passageway between the two tanks. If this type of failure occurs, it may be an extremely difficult failure to detect. The failure may only be detectable due to the fact that the failure prevents the manifold from operating properly when the defective manifold is assembled into a condenser and tested as a unit.

It is also possible that for a certain portion of the single channel length, the two ends of the sheet metal may float off the channel, creating a void between the two tanks. This type of a failure may be likely, since two separate parts must fit in a single space. Considering that the stamping presses are often run at a high speed to optimize production, the likelihood for this type of failure increases. This type of a failure is also problematic, since it is very difficult to inspect for this type of a failure once the manifold takes its final shape. Often, it is only detectable once the manifold is assembled onto a condenser and the air conditioner is operated for the first time.

SUMMARY OF THE INVENTION

The present invention is a stamped manifold for a heat exchanger including a central portion having a plurality of mating tubular members for connection to tubes of a heat exchanger. The manifold includes a plurality of folds disposed between the mating tubular members to form a pair of channels, a first channel and a second channel, below a plane of the central portion. The manifold also includes a single central fold above the plane of the central portion. The manifold includes a first extension member extending from a side edge of the central portion and a second extension member extending from an opposite side edge of the central portion and opposing the first extension member. The free ends of the first extension member and the second extension member are disposed and secured in the first channel and the second channel respectively, and secured in place to the central fold to define a first fluid conduit and a second fluid conduit.

The present invention is also a method of making a stamped manifold for a heat exchanger. The method includes the steps of providing a generally planar sheet having a central portion with a plurality of mating tubular members for connection to tubes of a heat exchanger. The method includes the step of folding the sheet and forming a plurality of folds between the mating tubular members to form a pair of channels below a plane of the central portion, and a central fold above a plane of the central portion. The method includes the step of folding lateral side edges of the sheet to form a first extension member and a second extension member opposing each other. The method includes the step of folding free ends of the first extension member and the second extension member toward each other and disposing the free ends in a first channel and a second channel, respectively. The method further includes the step of securing in place the free ends of the first extension member and the second extension member in the first channel and the second channel, respectively, and the free ends to the central fold to define a first fluid conduit and a second fluid conduit.

In the present invention a stamped manifold for a heat exchanger such as a condenser is provided, for example, for an air conditioning system of a motor vehicle for condensing liquid refrigerant. An advantage of the present invention is that the manifold uses an aluminum clad sheet that is stamped, folded and brazed to make a manifold. Another advantage of the present invention is that the manifold is stamped and folded and is therefore less costly and more economical to manufacture than an extruded manifold. By securing the free ends of the first and second extension members into the pair of channels and to the central fold to form the first and second fluid conduits, the present invention avoids the problems associated with the prior art wherein a free end may float off a single channel thus creating a void between the two tanks.

Other features and advantages of the present invention will be readily appreciated, as the same becomes better understood after reading the subsequent description taken in conjunction with the accompanying drawings.

DETAILED DESCRIPTION

Figure 1:
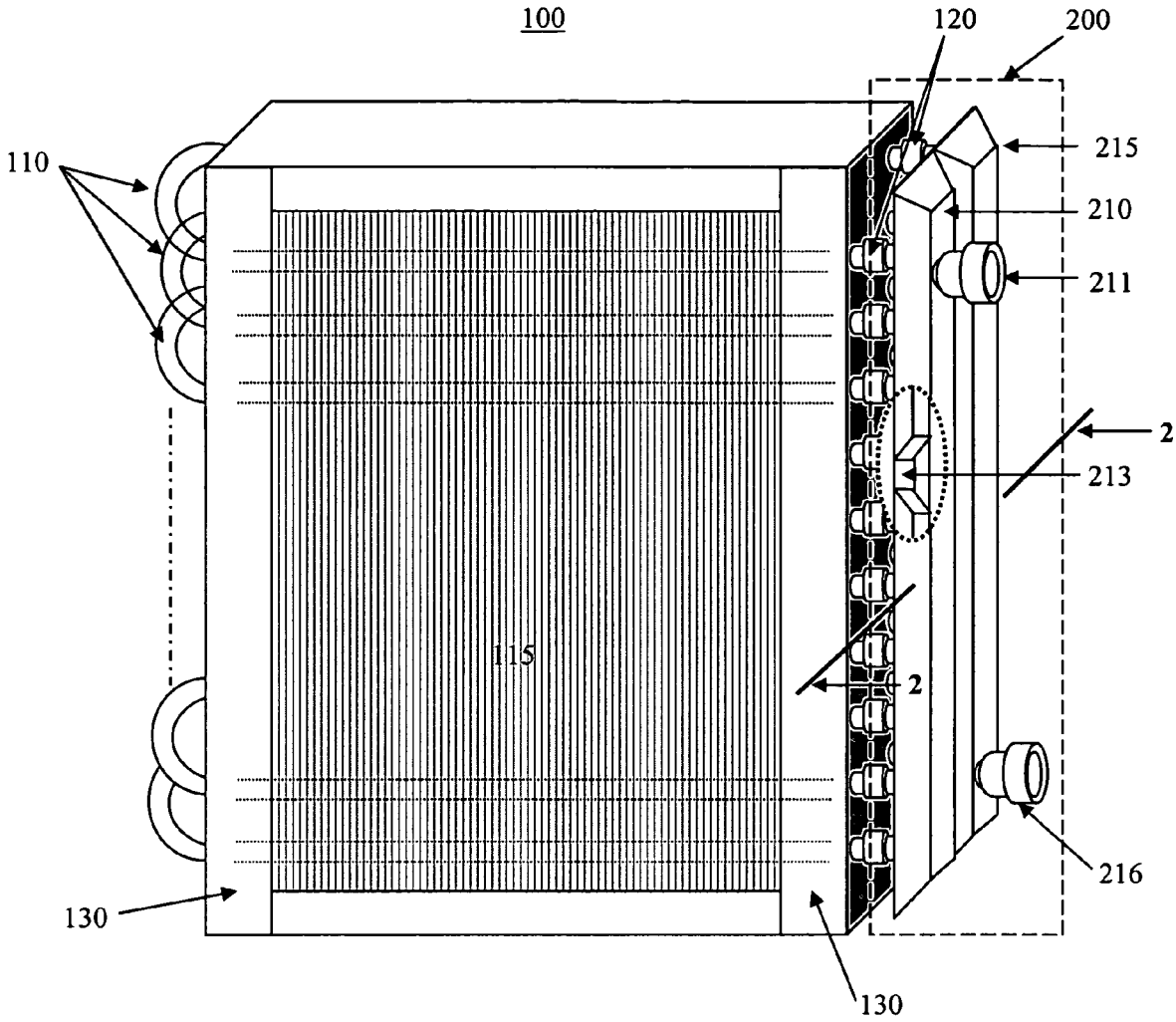
FIG. 1 is a perspective view of a manifold illustrated in operational relationship with a heat exchanger according to embodiments of the present invention.

Referring to the drawings and in particular FIG. 1, an embodiment of a heat exchanger 100, such as a condenser for an air conditioning system (not shown), is shown. The heat exchanger 100 is of a tube and fin type and includes a plurality of U-shaped tubes 110 with a plurality of heat dissipative fins 115 extending between each of the tubes 110. The heat exchanger 100 also includes a manifold 200, matingly engaging generally cup-shaped free ends 120 of the tubes 110, and disposed at one end of the heat exchanger 100. As illustrated, the manifold 200 is a double chambered manifold having a first fluid conduit 210 and a second fluid conduit 215. The first fluid conduit 210 includes an inlet port 211 for receiving fluid therein and the second fluid conduit 215 includes an outlet port 216 for discharge of fluid therefrom. Fluid to be cooled (or heated) enters the manifold 200 through the inlet port 211 and is directed through the tubes 110 wherein the fluid is cooled by a secondary fluid, for example air, passing over the fins 115. Baffles 213 in the manifold 200 direct the fluid through the tubes 110 wherein the fluid eventually discharges from outlet port 216. The heat exchanger 100 may include end plates 130 to support the tubes 110 for the manifold 200. It should be appreciated that, except for the manifold 200, the heat exchanger 100 is conventional and known in the art. It should also be appreciated that the manifold 200 could be used for heat exchangers in other applications besides motor vehicles.

Figure 2:
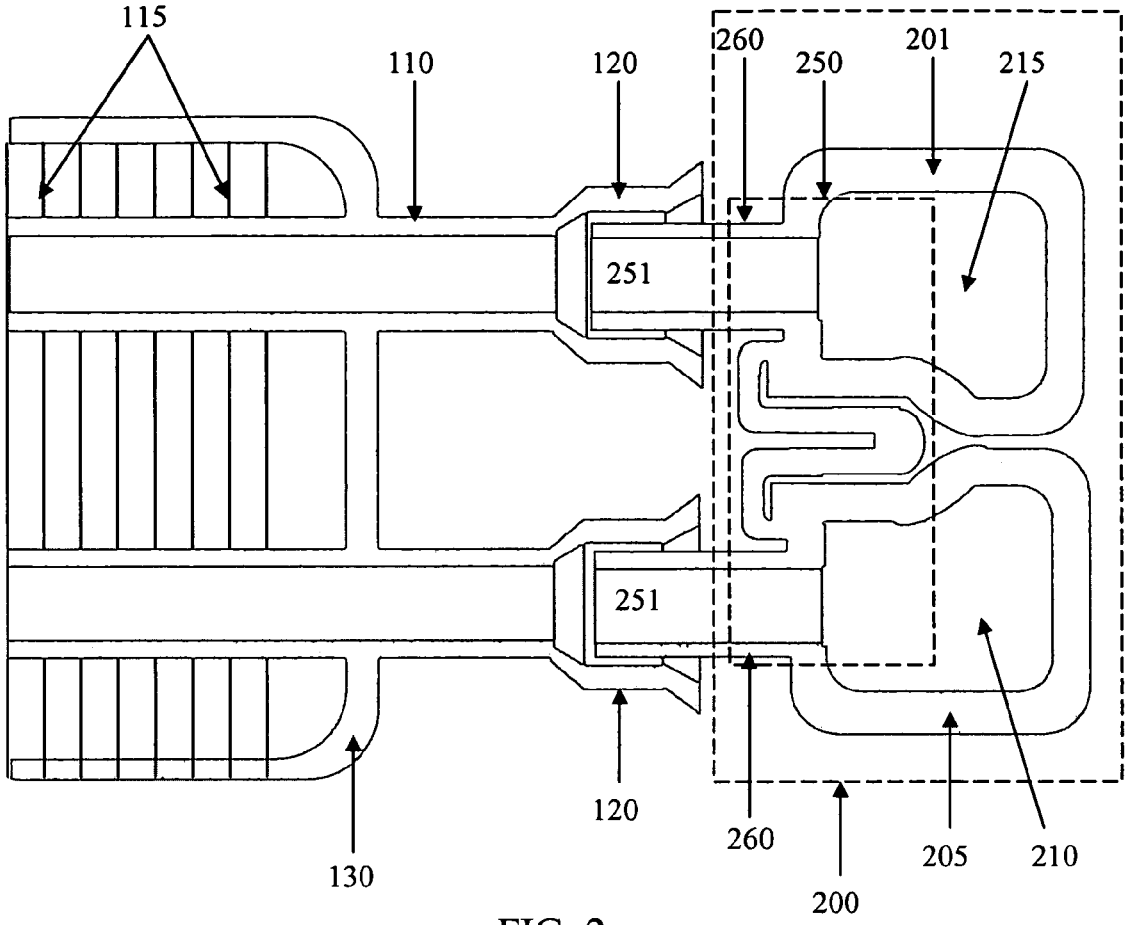
FIG. 2 is a sectional view taken along line 2-2 of FIG. 1 according to embodiments of the present invention.

Referring to FIGS. 1 and 2, the manifold 200 extends longitudinally. The manifold 200 includes a central portion 250 being generally planar and extending laterally. The manifold 200 also includes a plurality of mating tubular members 260 extending generally perpendicular to the central portion 250. The mating tubular members 260 have a generally circular cross-sectional shape with a fluid passageway 251 extending therethrough and fluidly communicating with the first fluid conduit 210 and the second fluid conduit 215.

The mating tubular members 260 and central portion 250 are integral, unitary and formed as one-piece from a metal material such as an aluminum alloy, often cladded on one side of the sheet metal. A clad aluminum sheet combines at least two separate aluminum alloys, with varying liquefying temperature. These alloys may have liquefying temperature that are 30 degrees or more apart from each other. A clad aluminum, when processed through a furnace, melts one layer of alloy, while maintaining the shape of the base layer of the sheet metal. This is achieved by having a controlled furnace temperature that maintains a specific temperature that melts only the alloy with the lower liquefying temperature, while not achieving a temperature hot enough to melt the second alloy with the higher liquefying temperature. The alloy with the lower liquefying temperature acts as a sealing agent, filling up open seams, voids, etc. The process is complete once the material is returned to ambient temperature. The mating tubular members 260 are secured to the tubes 110 by suitable means such as brazing.

The manifold 200 also includes a first extension member 201 along one side of the central portion 250. The first extension member 201 is generally arcuate in cross-sectional shape. The manifold 200 includes a second extension member 205 along the opposite side of the central portion 250 and opposing the first extension member 201. The second extension member 205 is generally arcuate in cross-sectional shape. The first and second extension members 201, 205 and the central portion 250 are also integral, unitary and formed as one piece from a metal material such as clad aluminum. The first extension member 201 and second extension member 205 may have any suitable cross-sectional shape.

Figure 4:
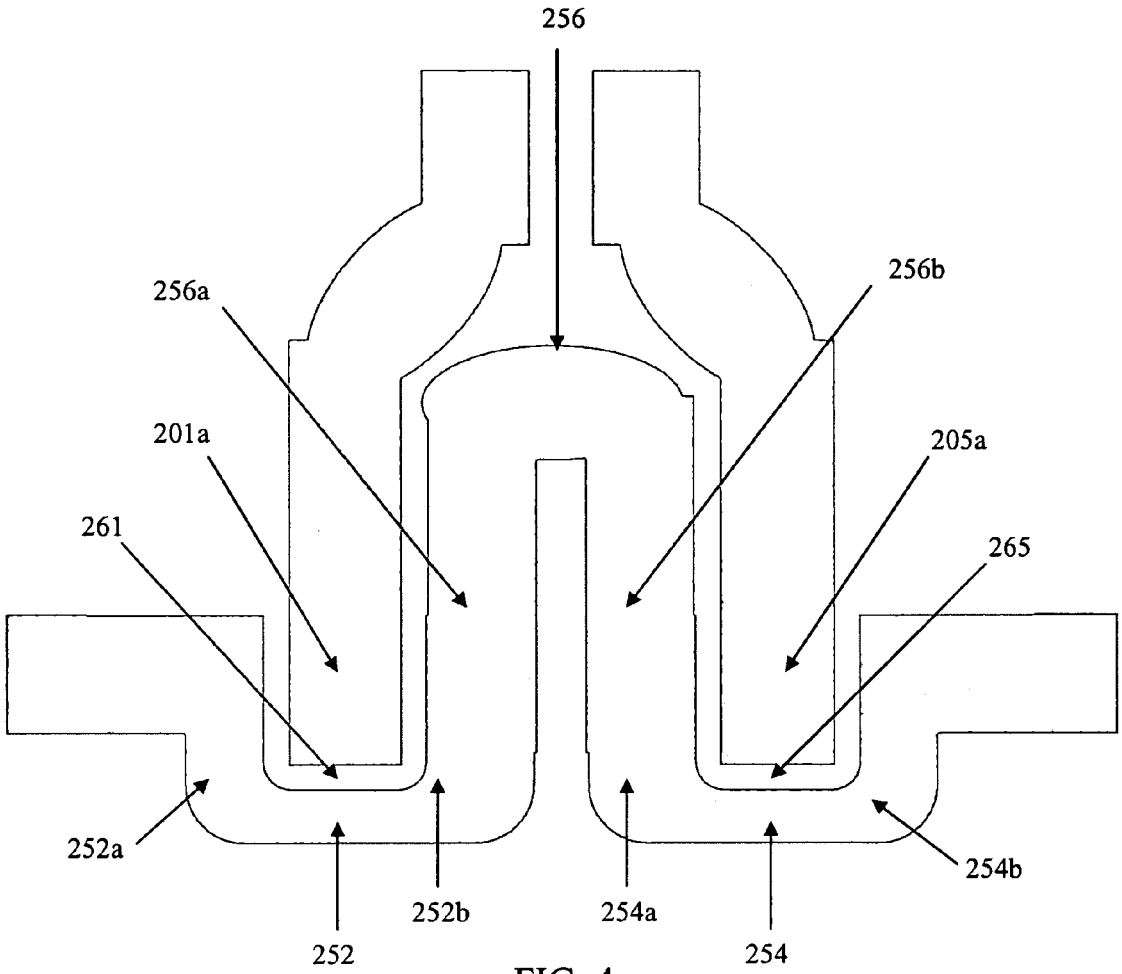
FIG. 4 is a view of a central portion according to embodiments of the present invention.

Referring to FIG. 2 and FIG. 4, the manifold 200 includes a plurality of folds 252, 254, 256 extending from the central portion 250 between a pair of laterally spaced mating tubular members 260 to form a pair of channels 261, 265 and a central fold 256. In the embodiment illustrated, two folds 252, 254 are spaced laterally and extend generally perpendicular to and below a plane of the central portion 250 to form a first channel 261 and a second channel 265. Each of the channels 261, 265 extends longitudinally and has a first portion 252*a*, 254*a* and a second portion 252*b*, 254*b*.

Figure 3A:
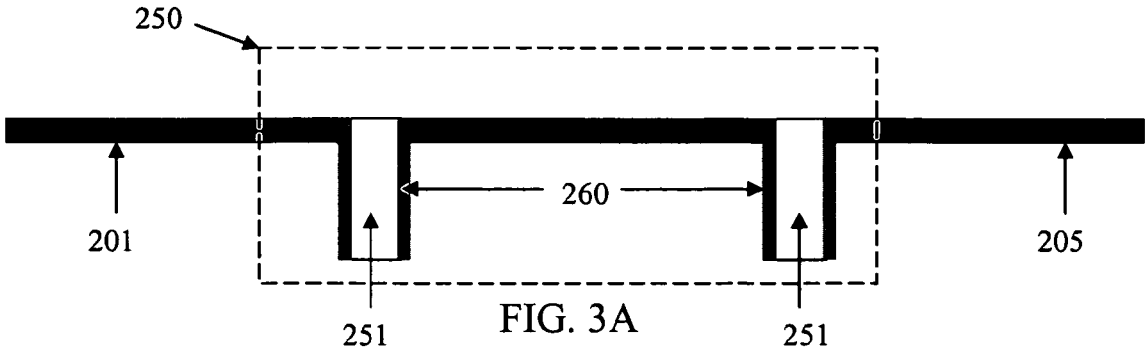
FIGS. 3A through 3G illustrate various shapes of the manifold during the manufacture of the manifold according to embodiments of the present invention.
Figure 5:
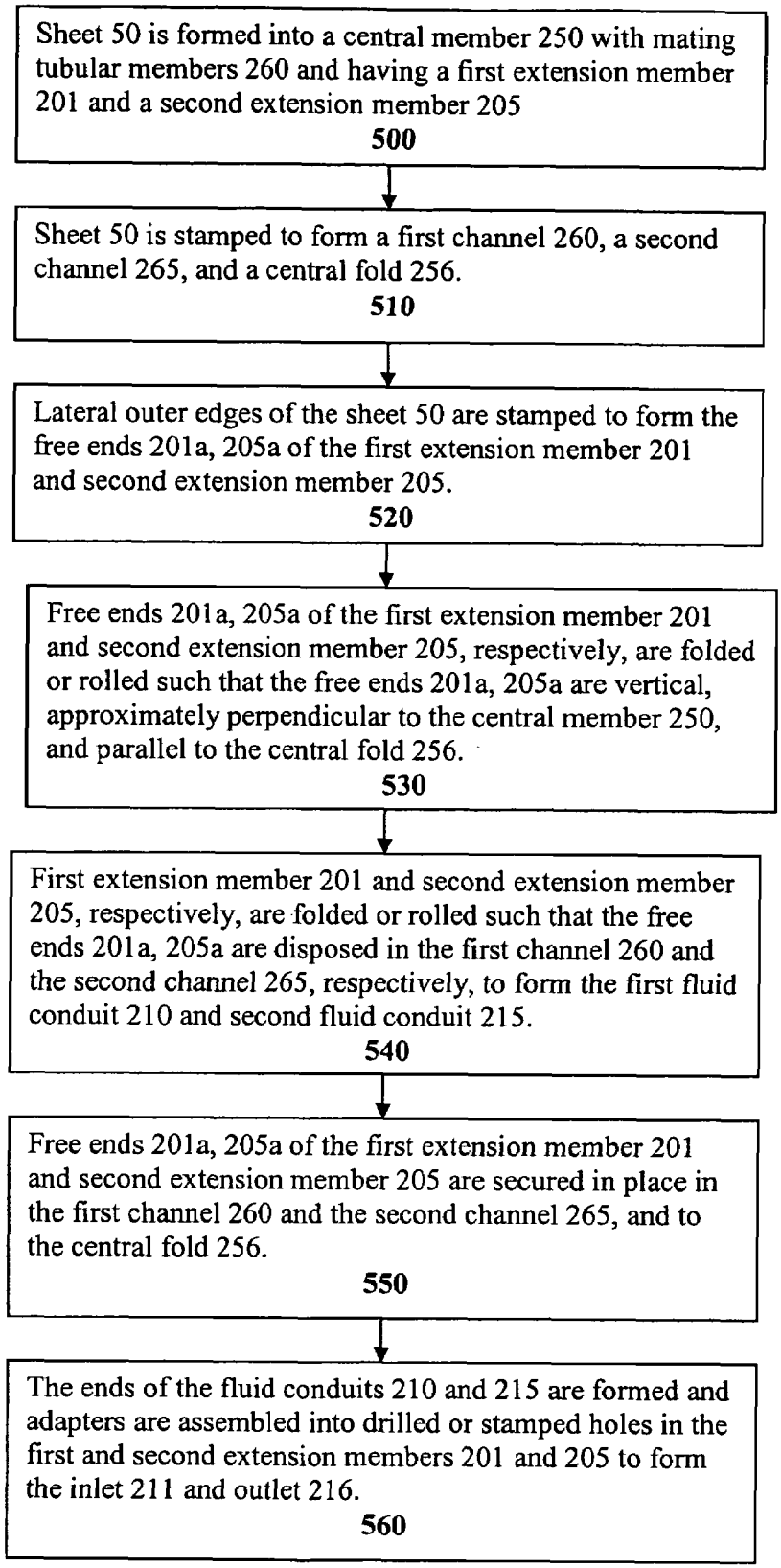
FIG. 5 illustrates a flow chart diagram of a method of manufacturing a manifold according to an embodiment of the present invention.

FIG. 5 illustrates a flow chart diagram of a method of manufacturing a manifold according to an embodiment of the present invention. Referring to FIG. 3A, a generally planar sheet 50 of elongate, deformable material such as an aluminum clad material is provided. The sheet 50 is formed 500 into a central portion 250 with mating tubular members 260 and having a first extension member 201 and a second extension member 205 along a longitudinal length thereof. The sheet 50 may be formed via a stamping process.

Figure 3B:
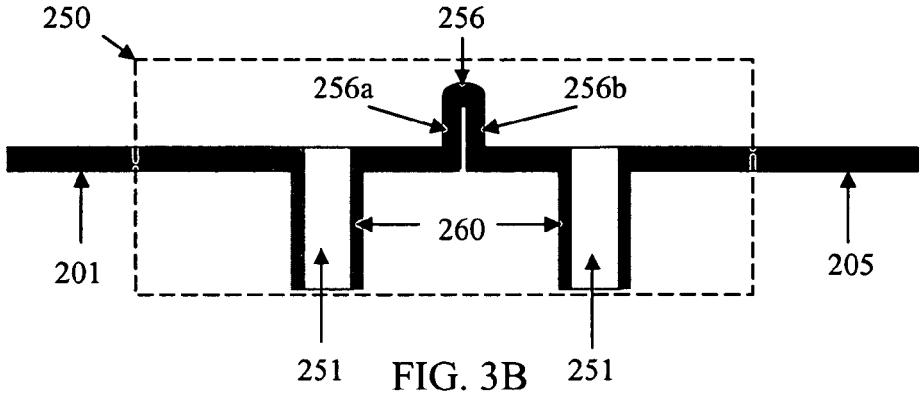
Figure 3C:
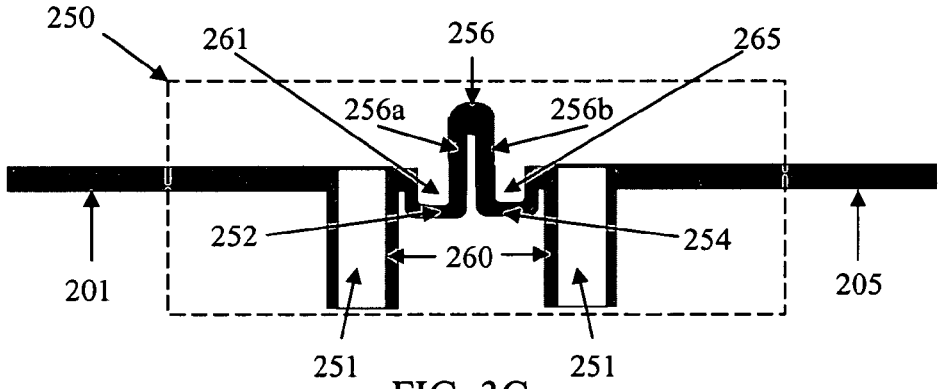

Referring to FIG. 3B, FIG. 3C and FIG. 4, the sheet 50 is stamped 510 to form a first channel 261, a second channel 265, and a central fold 256. The first channel 261, the second channel 265, the central fold 256 and central portion 250 are integral, unitary and formed as one-piece from the clad aluminum.

The sheet 50 is folded between two columns of mating tubular members 260 to form a plurality of folds 252, 254, 256, each having a first portion 252*a*, 254*a*, 256*a*, and a second portion 252*b*, 254*b*, 256*b*, respectively. The plurality of folds 252, 254, 256 are folded to predetermined fold heights above and below a plane of the central portion 250. The plurality of folds 252, 254, 256 extend from the central portion 250 between a pair of laterally spaced mating tubular members 260 to form the first channel 261, the second channel 265, and the central fold 256. Two folds 252, 254 are spaced laterally and extend generally perpendicular to and below a plane of the central portion 250 to form the first channel 261 and the second channel 265. Each of the channels 261, 265 extends longitudinally and has the first portion 252*a*, 254*a* and the second portion 252*b*, 254*b*. Each channel 261, 265 is formed by folding the central portion 250 to form the first portion 252*a*, 254*a* and then folding the central portion 250 back on itself to form the second portion 252*b*, 254*b* to obtain a predetermined fold height. In the embodiment illustrated, the predetermined fold height is approximately 2.0 mm. The central fold 256 is located between the first channel 261 and the second channel 265 and extends generally perpendicular to and above the plane of the central portion 250. The central fold 256 is formed by folding the central portion 250 to form a first portion 256*a* and then folding the central portion 250 back on itself to form a second portion 256*b* to obtain a predetermined fold height. In the embodiment illustrated, the predetermined fold height is approximately 3.0 mm.

Figure 3D:
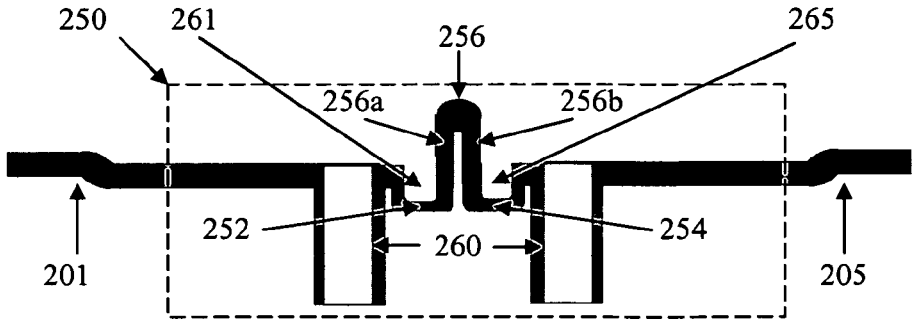

Referring to FIG. 3D, the lateral outer edges of the sheet 50 are stamped 520 to form the free ends 201*a*, 205*a* of the first extension member 201 and second extension member 205.

Figure 3E:
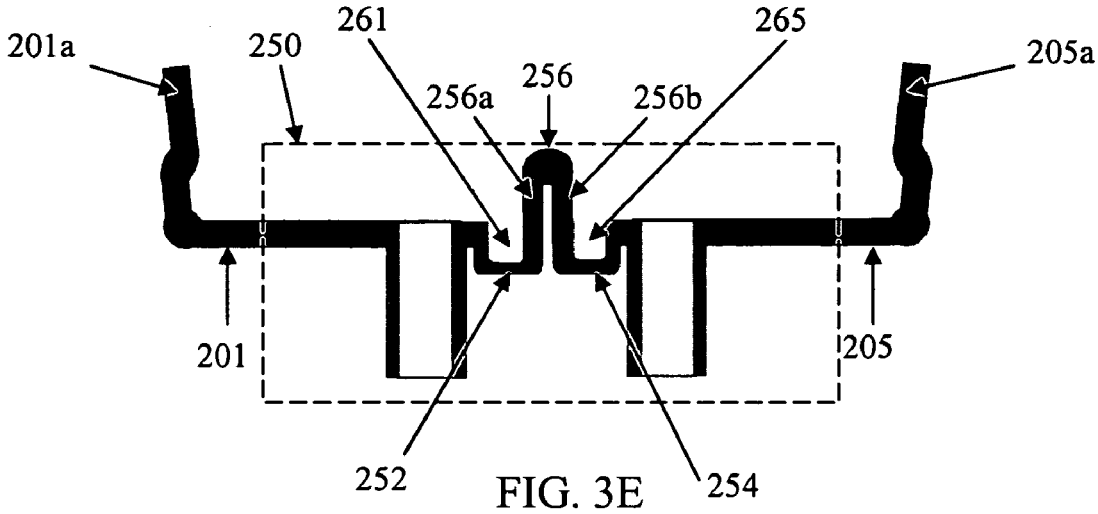

The free ends 201*a*, 205*a* of the first extension member 201 and second extension member 205, respectively, are folded or rolled 530 such that the free ends 201*a*, 205*a* are vertical, approximately perpendicular to the central portion 250, and parallel to the central fold 256 as illustrated in FIG. 3E.

Figure 3F:
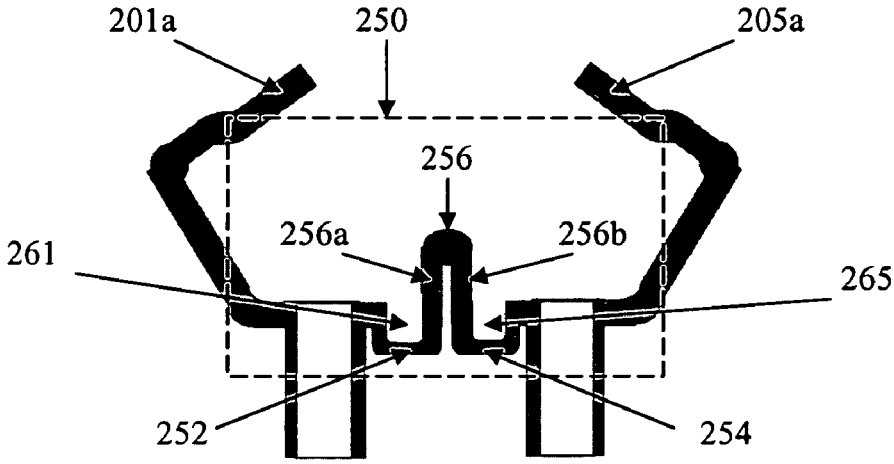
Figure 3G:
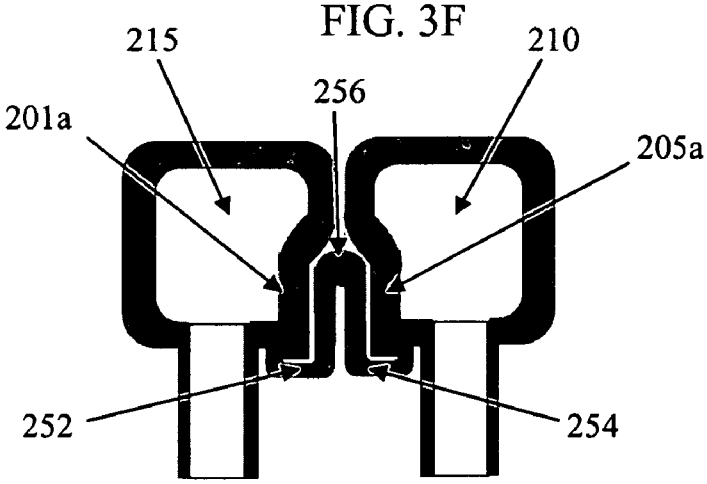

Referring to FIG. 3F and FIG. 3G, the first extension member 201 and second extension member 205, respectively, are folded or rolled 540 such that the free ends 201*a*, 205*a* become disposed in the first channel 261 and the second channel 265, respectively, to form the first fluid conduit 210 and second fluid conduit 215, respectively. Also, the exterior surfaces of the free ends 201*a*, 205*a* of the first extension member 201 and second extension member 205 abut against the first 256*a* and second 256*b* surfaces respectively of the central fold 256 in formation of the first fluid conduit 210 and second fluid conduit 215, respectively, (see also FIG. 4).

The free ends 201*a*, 205*a* of the first extension member 201 and second extension member 205 are secured 550 in place in the first channel 261 and the second channel 265, respectively. Also, the exterior surfaces of the free ends 201*a*, 205*a* of the first extension member 201 and second extension member 205 are secured in place against the first 256*a* and second 256*b* surfaces respectively of the central fold 256.

The free ends 201*a*, 205*a* of the first extension member 201 and second extension member 205 may be secured in place by brazing and cooling the manifold 200. The manifold 200 is heated to a predetermined temperature to melt the brazing material to braze the free ends 201*a*, 205*a* of the first extension member 201 and second extension member 205 in place in the first channel 261 and the second channel 265, respectively, and the exterior surfaces of the free ends 201*a*, 205*a* of the first extension member 201 and second extension member 205 in place against the first 256*a* and second 256*b* surfaces respectively of the central fold 256. As a result, the brazing material flows between the central fold 256, first channel 261, second channel 265, free end 201*a* and free end 205*a* by capillary flow action to braze the free end 201*a* and the free end 205*a* together in the first channel 261 and the second channel 265, respectively, and to the central fold 256.

The manifold 200 is cooled to solidify the molten braze material to secure the free ends 201*a*, 205*a* of the first extension member 201 and second extension member 205 in the first channel 261 and the second channel 265, respectively, and to secure the exterior surfaces of the free ends 201*a*, 205*a* of the first extension member 201 and second extension member 205 against the first 256*a* and second 256*b* surfaces respectively of the central fold 256.

The ends of the fluid conduits 210 and 215 are formed 560 and adapters are assembled into drilled or stamped holes in the first and second extension members 201 and 205 to form the inlet 211 and outlet 216.

Accordingly, the manufacture of the manifold 200 realizes a cost reduction over current manifolds that are made from a dual extruded tube with mating tubular members back extruded. The manifold 200 has a sheet with extruded mating tubular members or risers and is folded and brazed to make the manifold.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A manifold for a heat exchanger comprising:

a central portion having a plurality of mating tubular members for connection to tubes of a heat exchanger;

a plurality of folds disposed between said mating tubular members to form a first channel and a second channel below a plane of said central portion and a central fold above the plane of said central portion;

a first extension member extending from a first side edge of said central portion;

a second extension member extending from a second side edge of said central portion and opposing said first extension member; and a first free end of said first extension member and a second free end of said second extension member being disposed in said first channel and said second channel, respectively, and secured to said central fold to define a first fluid conduit and a second fluid conduit.

2. A manifold according to claim 1 wherein said central portion, said first channel, said second channel, said central fold, said first extension member, and said second extension member are integral, unitary and formed as one-piece.

3. A manifold according to claim 1 wherein said folds comprise a first fold and a second fold spaced laterally, extending longitudinally, and generally perpendicular below said central portion, and the central fold extending longitudinally, and generally perpendicular above and central to the central portion.

4. A manifold according to claim 1 wherein each of said first fold, said second fold, and said central fold include a first portion and a second portion adjacent said first portion and being formed from said central portion.

5. A manifold according to claim 1 wherein said first extension member and said second extension member have a generally arcuate shape.

6. A manifold according to claim 1 wherein said manifold is formed by a stamping process.

7. A manifold according to claim 1 wherein said manifold is made from a clad aluminum sheet.

8. A method of making a manifold for a heat exchanger comprising:

providing a generally planar sheet having a central portion with a plurality of mating tubular members for connection to tubes of a heat exchanger;

stamping the sheet and forming a plurality of folds between the mating tubular members to form a first channel and a second channel below a plane of said central portion and a central fold above the plane of said central portion;

stamping lateral side edges of the sheet to form a first extension member and a second extension member opposing each other;

folding free ends of the first extension member and the second extension member toward each other and disposing the free ends in said first channel and said second channel respectively; and securing the free ends of the first extension member and the second extension member in place in said first channel and said second channel respectively, and securing the free ends of the first extension member and the second extension member to said central fold to define a first fluid conduit and a second fluid conduit.

9. A method according to claim 8 wherein the sheet is a clad aluminum sheet.

10. A method according to claim 8 wherein securing the free ends includes brazing.

11. A method according to claim 8 wherein stamping the sheet and forming the folds comprises folding the sheet and forming a first portion of the first channel and folding the sheet back on itself to form a second portion of the first channel.

12. A method according to claim 8 wherein stamping the lateral side edges comprises flanging the lateral side edges of the sheet to form the first extension member and the second extension member opposing each other.

13. A method according to claim 8 wherein folding the free ends comprises rolling the free ends of the first extension member and the second extension member toward each other and disposing the free ends in the first channel and the second channel, respectively, to define a first fluid conduit and a second fluid conduit.

14. A method according to claim 8 wherein providing the generally planar sheet comprises providing a stamped planar sheet having a central portion with a plurality of mating tubular members for connection to tubes of a heat exchanger.

15. A method according to claim 8 including compressing the folds and free ends of the first extension member and second extension member.

* * * * *